US006729270B1

(12) United States Patent
Betz et al.

(10) Patent No.: US 6,729,270 B1
(45) Date of Patent: May 4, 2004

(54) INCREASED CAPACITY COOLING SYSTEM FOR A WORK MACHINE

(75) Inventors: Michael D. Betz, Knoxville, IL (US); Jared P. Johnson, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/328,068

(22) Filed: Dec. 23, 2002

(51) Int. Cl.[7] ..... F01P 11/08
(52) U.S. Cl. ..... 123/41.33; 123/196 AB
(58) Field of Search ..... 123/41.31, 196 AB, 123/41.33

(56) References Cited

U.S. PATENT DOCUMENTS 4,352,342 A * 10/1982 Cser et al. ..... 123/41.54
5,033,540 A 7/1991 Tategami et al.
5,720,341 A 2/1998 Watanabe et al.
6,209,628 B1 4/2001 Sugimoto et al.
6,213,196 B1 4/2001 Ozaki et al.

FOREIGN PATENT DOCUMENTS

DE 3047672 A * 7/1982 ..... F01P/3/00

* cited by examiner

*Primary Examiner*—Noah P. Kamen
(74) *Attorney, Agent, or Firm*—Thomas Derry; Jeff A Greene

(57) ABSTRACT

The present invention relates to a cooling circuit for a work machine that provides increased cooling capacity of a radiator without increasing the physical size of the radiator. The cooling circuit includes a jacket water pump, a jacket water portion of an engine and a radiator fluidly coupled to the circuit. A first powertrain oil cooler is fluidly coupled to the cooling circuit between the jacket water pump and the jacket water portion. A second powertrain oil cooler is fluidly coupled to the cooling circuit between the jacket water portion and the radiator. Positioning of the powertrain oil coolers in this manner increases the temperature differential between ambient air and coolant entering the radiator, therefore increasing cooling capacity of the radiator.

16 Claims, 2 Drawing Sheets

INCREASED CAPACITY COOLING SYSTEM FOR A WORK MACHINE

TECHNICAL FIELD

This invention relates generally to a work machine and more specifically to a work machine having a powertrain oil cooler positioned in the coolant system between the engine and the radiator.

BACKGROUND

Work machines such as track type tractors and the like include numerous systems that are cooled by heat exchangers and radiator coolant. A typical work machine may include a liquid cooled internal combustion engine, a powertrain having a coolant-to-oil heat exchanger and a coolant-to-engine oil heat exchanger. Coolant is pumped by a jacket water pump to the heat exchangers, through the engine to a radiator and back to the pump. Typically the powertrain oil is at the hottest temperature, thus requiring the most cooling. Therefore the coolant from the coolant pump goes to the powertrain oil heat exchanger and engine oil heat exchanger prior to going to the engine water jacket.

Most engine manufacturers are redesigning their internal combustion engines to have lower exhaust emissions. The new engines require a higher cooling capacity. To achieve the higher cooling capacity a larger radiator is normally required. Most work machines don't have extra space to accommodate the larger radiator without major redesign.

It is desirable to provide a work machine having improved engine cooling without redesigning the entire machine to accommodate a larger radiator.

SUMMARY OF THE INVENTION

In an embodiment of the present invention a cooling circuit for an engine and a powertrain is provided. The cooling circuit includes a jacket water pump to circulate coolant through a jacket water portion of an engine and a radiator. A first powertrain oil cooler is fluidly coupled to the cooling circuit between said jacket water pump and said jacket water portion. A second powertrain oil cooler is fluidly coupled to the cooling circuit between said jacket water portion and the radiator.

In another embodiment of the present invention a method of increasing the cooling capacity of a work machine is provided. The work machine includes an engine and a powertrain. The method includes the step of providing a cooling circuit having a jacket water pump, an engine jacket water portion and a radiator. Next a first powertrain oil cooler fluidly coupled to the cooling circuit at a position between the jacket water pump and the jacket water portion is provided. Lastly, a second powertrain oil cooler fluidly coupled to the cooling circuit at a position between jacket water portion and the radiator.

In another embodiment of the present invention a cooling circuit for an engine and a powertrain is provided. The cooling circuit includes a jacket water pump to circulate coolant through a jacket water portion of an engine and a radiator. An engine oil cooler is fluidly coupled to the cooling circuit between said jacket water pump and said jacket water portion.

BRIEF DESCRIPTION OF THE DRAWINGS

FIG. 1 is an illustration of a work machine that the cooling system of the present invention may be used on.

DETAILED DESCRIPTION

Figure 1:
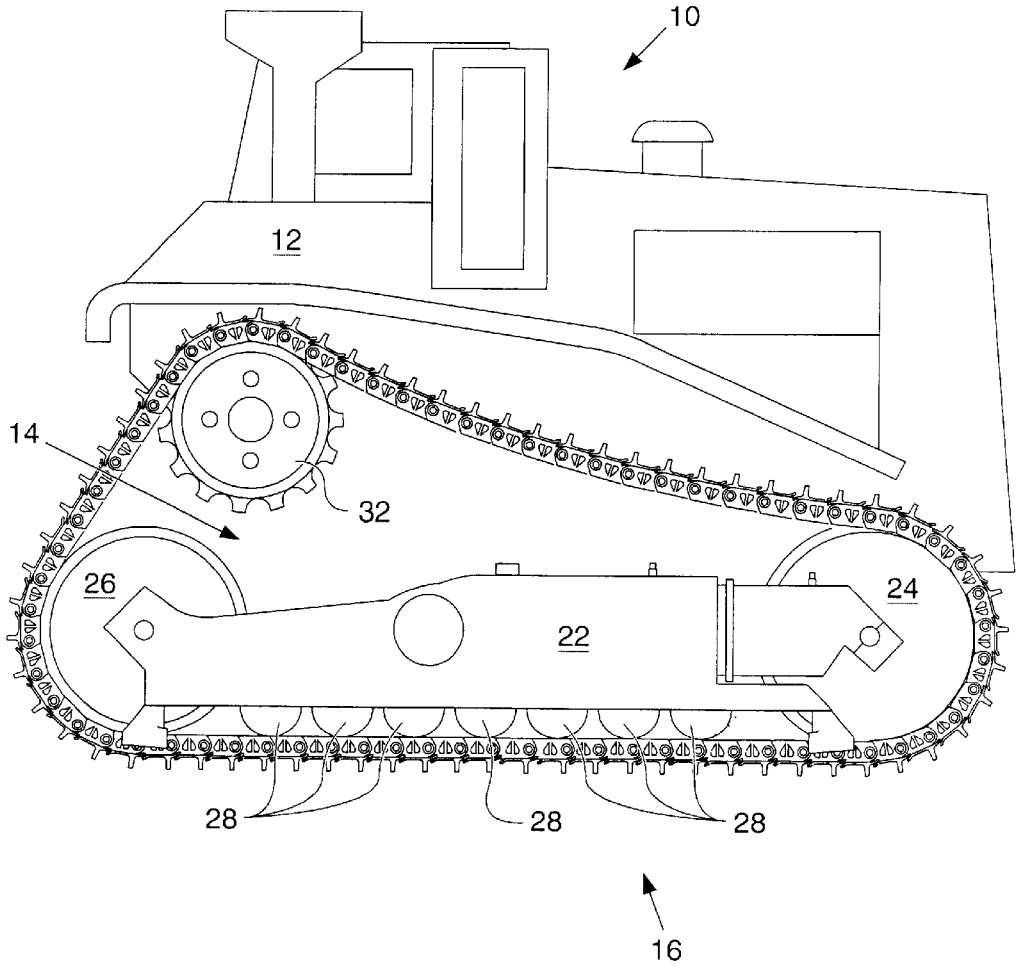

Referring to FIG. 1, a work machine 10 such as a track type tractor 12 is illustrated. The track type tractor 12 includes a frame shown generally as 14 and an engine 80 (shown in FIG. 2) mounted on the frame 14. The engine 80 drivingly engages a powertrain 15 (shown in FIG. 2) that is coupled to an undercarriage assembly 16, for propelling the machine about the ground. The undercarriage assembly 16 includes a right side, seen in FIG. 1, and a left side (not shown) is attached to the frame 14. The undercarriage assembly 16 includes a frame rail 22 having a front idler 24 and a rear idler 26 mounted thereupon. Pluralities of bogie wheels 28 are positioned below the frame rail 22 to support the machine on the track assembly 12. A drive sprocket 32 is positioned above the undercarriage 16 and is drivingly coupled the engine. The track assembly 12 encompasses the undercarriage assembly 16 and engages the drive sprocket 32, front idler 24, rear idler 26 and bogie wheels 28.

Figure 2:
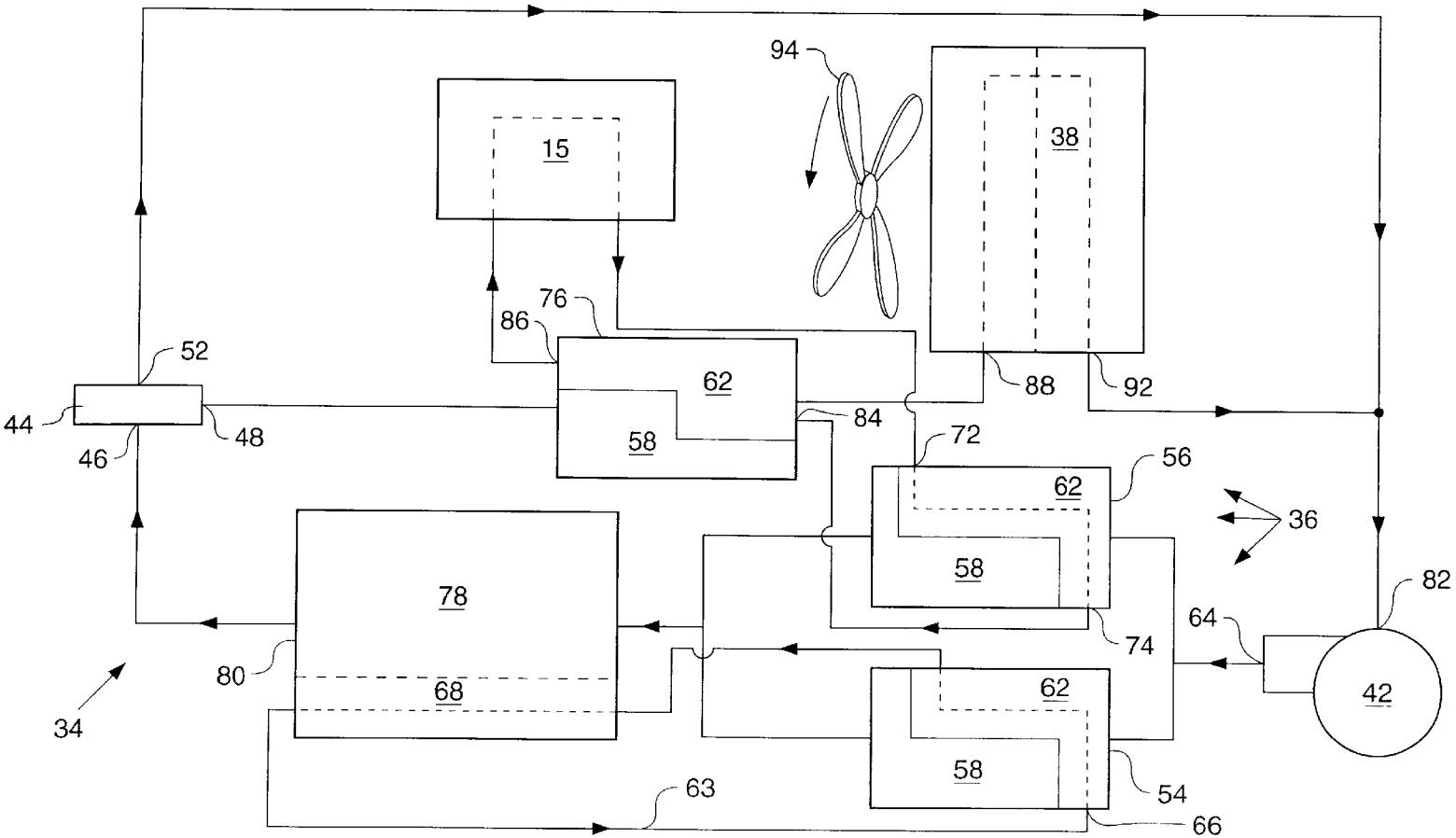
FIG. 2 is a schematic representation of an embodiment of the present invention.

Referring now to FIG. 2, a cooling circuit 34 for the tractor 12 is illustrated. Coolant circulates throughout the cooling circuit 34 in a typical manner, absorbing heat from a plurality of components 36 and dissipating the heat through a radiator 38. The cooling circuit 34 includes the radiator 38, a jacket water pump 42, and a thermostat housing 44. The thermostat housing 44 includes an inlet 46, an outlet 48 and a bypass portion 52.

The plurality components are connected to the cooling circuit by conduits and hoses in a typical fashion. An engine oil cooler 54 and a first powertrain oil cooler 56 each include a coolant portion 58 and an oil portion 62. The coolant portions 58 of the engine oil cooler 54 and the first powertrain oil cooler 56 are connected in parallel to an outlet 64 of the jacket water pump 42. Engine lubricating oil 63 is routed into an inlet 66 of the oil portion 62 of the engine oil cooler 54. After passing through the oil cooler 54 the oil 63 flows to an engine oil sump 68. While passing through the engine oil cooler 54, heat from the oil is transferred to the coolant. Typically it is desirable to maintain the temperature of the engine oil below 110° C. before it enters the engine oil cooler 54.

The oil portion 62 of the first powertrain oil cooler 56 includes an inlet 72 and an outlet 74. Pressurized oil from the powertrain enters the first powertrain oil cooler 56 inlet 72 and exists through the outlet 74. From the outlet 74 of the first powertrain oil cooler 56, oil is directed to a second powertrain oil cooler 76. A typical maximum temperature of the powertrain oil entering the first powertrain cooler 56 is 121° C.

Coolant from the engine oil cooler 54 and first powertrain oil cooler 56, flows through a water jacket portion 78 of the engine 80. Combustion heat from the engine 80 is then transferred to the coolant. Maximum temperature of the coolant before leaving the water jacket 78 may is approximately 99° C.

From the water jacket portion 78 the coolant flows to the thermostat housing 44. If the temperature of the coolant is above a predetermined value, the coolant flows to a second powertrain oil cooler 76. If the temperature of the coolant is below the predetermined value, a portion of the coolant flows through the bypass portion 52 to an inlet 82 of the jacket water pump 42.

Powertrain oil exiting the first powertrain cooler 56 enters the inlet 84 of the second powertrain cooler 76 and exits through the outlet 86. Simultaneously, coolant from the thermostat housing 44 outlet 48 flows through the coolant portion 58 of the second powertrain oil cooler 76 to further cool the powertrain oil.

The first and second powertrain oil coolers 56, 76 must be sized to remove the proper amount of heat from the powertrain oil. It can be estimated that powertrain having a first and second oil cooler 56, 76 would use two coolers that have cooling capacities slightly greater than fifty percent of a single cooler. The increased total capacity of the first and second powertrain oil coolers 56, 76 is due to the increase temperature of the coolant entering the second powertrain oil cooler 76.

From the second powertrain oil cooler 76, coolant flows into a radiator inlet 88 through the radiator 38 and exits through a radiator outlet 92. Typically ambient air is drawn across the radiator 38 via a mechanical or electrically driven fan 94. As air passes over the radiator 38, it absorbs heat from the coolant. Coolant from the radiator 38 flows back to the jacket water pump 42 and repeats the cycle.

In one alternative of the present invention an automatic valve (not shown) may be provided in the coolant circuit. The valve is adapted to bypass the engine water jacket 78 and direct coolant to the second powertrain oil cooler 76. This alternative may be used when the engine 80 temperature is low and powertrain oil temperature is high, such as during retarding of the work machine 10. Retarding refers to slowing the machine 10 using engine 80 compression instead of brakes.

In another alternative of the present invention the engine oil cooler 54 may be positioned in the cooling circuit 34 after the engine water jacket 78. Similar to positioning the second powertrain oil cooler 76 after the water jacket 78, the higher temperatures of engine 80 oil may be transferred to coolant without impacting maximum engine coolant temperature.

Industrial Applicability

In operation the cooling system using a first and second powertrain oil cooler 56, 76 provides greater engine 80 cooling through the radiator 38 without increasing the size of the radiator 38. The coolant entering the radiator 38 is at a higher temperature after passing through the second powertrain oil cooler 76 last, as opposed to passing through the engine 80 water jacket portion 78 last. Having a higher differential between the temperature of coolant entering the radiator 38 and ambient air increases the total amount of heat transfer of the radiator 38.

What is claimed is:

1. A cooling circuit for an engine and a powertrain, said cooling circuit comprising:

a jacket water pump adapted to circulate coolant through a jacket water portion of an engine and a radiator;

a first powertrain oil cooler fluidly coupled to said cooling circuit between said jacket water pump and said jacket water portion; and a second powertrain oil cooler fluidly coupled to said cooling circuit between said jacket water portion and said radiator.

2. The cooling circuit of claim 1, further including an engine oil cooler, said engine oil cooler being fluidly coupled to said cooling circuit in parallel with said first powertrain oil cooler.

3. The cooling circuit of claim 1, further including an engine oil cooler, said engine oil cooler being positioned to said cooling circuit between said jacket water portion and said radiator.

4. The cooling circuit of claim 1, including a valve arrangement, said valve arrangement being configured to divert flow of at least a portion of said coolant to bypass said jacket water portion.

5. The cooling circuit of claim 4, wherein coolant flow is diverted based upon the powertrain being in a retarding state.

6. The cooling circuit of claim 4, wherein said valve is configured to operate automatically.

7. A work machine having a frame, an engine and a powertrain adapted to move said work machine about the ground, said work machine having a cooling circuit comprising:

a jacket water pump adapted to circulate coolant through a jacket water portion of an engine, and a radiator;

a first powertrain oil cooler fluidly coupled to said cooling circuit between said jacket water pump and said jacket water portion; and a second powertrain oil cooler fluidly coupled to said cooling circuit between said jacket water portion and said radiator.

8. The work machine of claim 7, further including an engine oil cooler, said engine oil cooler being fluidly coupled to said cooling circuit in parallel with said first powertrain oil cooler.

9. The work machine of claim 7, further including an engine oil cooler, said engine oil cooler being fluidly coupled to said cooling circuit between said jacket water portion and said radiator.

10. The work machine of claim 7, including a valve arrangement, said valve arrangement being configured to divert flow of at least a portion of said coolant in a manner to bypass said jacket water portion based upon a retarding condition of said powertrain.

11. The work machine of claim 10, wherein said valve is configured to operate automatically.

12. A method of increasing the cooling capacity of a work machine having an engine and a powertrain, said method comprising:

providing a cooling circuit having a jacket water pump, an engine jacket water portion and a radiator;

providing a first powertrain oil cooler fluidly coupled to said cooling circuit at a position between said jacket water pump and said jacket water portion; and providing a second powertrain oil cooler fluidly coupled to said cooling circuit at a position between said jacket water portion and said radiator.

13. The method of increasing the cooling capacity of said work machine of claim 12, including the step of providing an engine oil cooler fluidly coupled to said cooling circuit in parallel with said first powertrain oil cooler.

14. The method of increasing the cooling capacity of said work machine of claim 12, including the step of providing an engine oil cooler fluidly coupled to said cooling circuit between said jacket water portion and said radiator.

15. The method of increasing the cooling capacity of said work machine of claim 12, including the step of providing a valve configured to divert coolant directly from said first powertrain oil cooler to said second powertrain oil cooler.

16. The method of increasing the cooling capacity of said work machine of claim 15, wherein said step of providing a valve includes providing an automatically actuated valve.

* * * * *